US006251248B1

(12) United States Patent
Lin

(10) Patent No.: US 6,251,248 B1
(45) Date of Patent: Jun. 26, 2001

(54) MICROFABRICATION PROCESS FOR MAKING MICROSTRUCTURES HAVING HIGH ASPECT RATIO

(76) Inventor: Ching-Bin Lin, 2F-2, No. 12, Lane 88, Min-Sheng E. Road, Sec. 3, Taipei, 104 (TW)

( * ) Notice: Subject to any disclaimer, the term of this patent is extended or adjusted under 35 U.S.C. 154(b) by 0 days.

(21) Appl. No.: 09/422,092

(22) Filed: Oct. 15, 1999

(51) Int. Cl.[7] ..... C25D 1/00
(52) U.S. Cl. ..... 205/67; 205/122
(58) Field of Search ..... 205/67, 70, 122, 205/78

(56) References Cited

U.S. PATENT DOCUMENTS 3,152,938 * 10/1964 Osifchin et al. ..... 156/3
3,322,653 * 5/1967 Morris ..... 204/3
5,098,860 * 3/1992 Chakravorty et al. ..... 437/195
5,501,784 * 3/1996 Lessmöllmann et al. ..... 205/67
5,770,465 * 6/1998 MacDonald et al. ..... 437/67

* cited by examiner

*Primary Examiner*—Kathryn Gorgos
*Assistant Examiner*—Erica Smith-Hicks

(57) ABSTRACT

A microfabrication process for making a microstructure product comprises: micromachining a polymer substrate for forming a three-dimensional microstructure pattern with deep cavities; shrinking and minimizing the diameter or width of each cavity of the microstructure pattern by steadily swelling the polymer, which is prefixed on a cathode of an electroforming system, by saturating the electrolyte solution into the polymer; electroforming in the electroforming system electrically connected with an anode and the cathode for filling metal in the cavities in the polymer; and desorption of the electrolyte from the polymer to shrink the polymer to be separated from an electroformed microstructure product, and demolding for obtaining the microstructure product having a high aspect ratio of 100 or even higher. The diameter or width of each cavity is shrunk to be smaller, thereby increasing the aspect ratio of the microstructure product.

4 Claims, 3 Drawing Sheets

MICROFABRICATION PROCESS FOR MAKING MICROSTRUCTURES HAVING HIGH ASPECT RATIO

BACKGROUND OF THE INVENTION

In order for making microstructures of high aspect ratio, there are many processes, including LIGA, LIGA like, UV photolithography, etc., ever being disclosed for such a purpose. However, such conventional processes are complex and expensive so that they are uneconomic and infeasible on a commercial point of view.

A conventional process for manufacturing high aspect ratio microstructures was disclosed by using a trench-filling etch masking technique by etching deep trenches into a substrate, filling trench filling material in the trenches, and deep etching into the substrate being carried out with the trench-filling material serving as a mask. However, such a prior art requires many process steps for finishing the microstructures, still being time-consuming and lowering production efficiency.

The present inventor has found the drawbacks of the conventional processes, and invented the present microfabrication process more economic and feasible for making microstructures.

SUMMARY OF THE INVENTION

The object of the present invention is to provide a microfabrication process including the steps of:

a. preparing an electrolyte solution to be filled in an electroforming system;

b. forming an electrically insulative masking thin film on a polymer substrate;

c. micromachining the substrate for forming three-dimensional microstructure pattern with deep cavities;

d. shrinking the width or diameter of each cavity of the microstructure pattern by steadily swelling the polymer, which is prefixed on a cathode of the electroforming system, by saturating the electrolyte solution into the polymer;

e. electroforming in the electroforming system electrically connected with an anode and the cathode for filling metal in the cavities in the polymer; and f. desorption of the electrolyte from the polymer to shrink the polymer to be separated from an electroformed microstructure product, and demolding for obtaining the microstructure product having a high aspect ratio of 100 or even higher.

DETAILED DESCRIPTION

Figure 2:
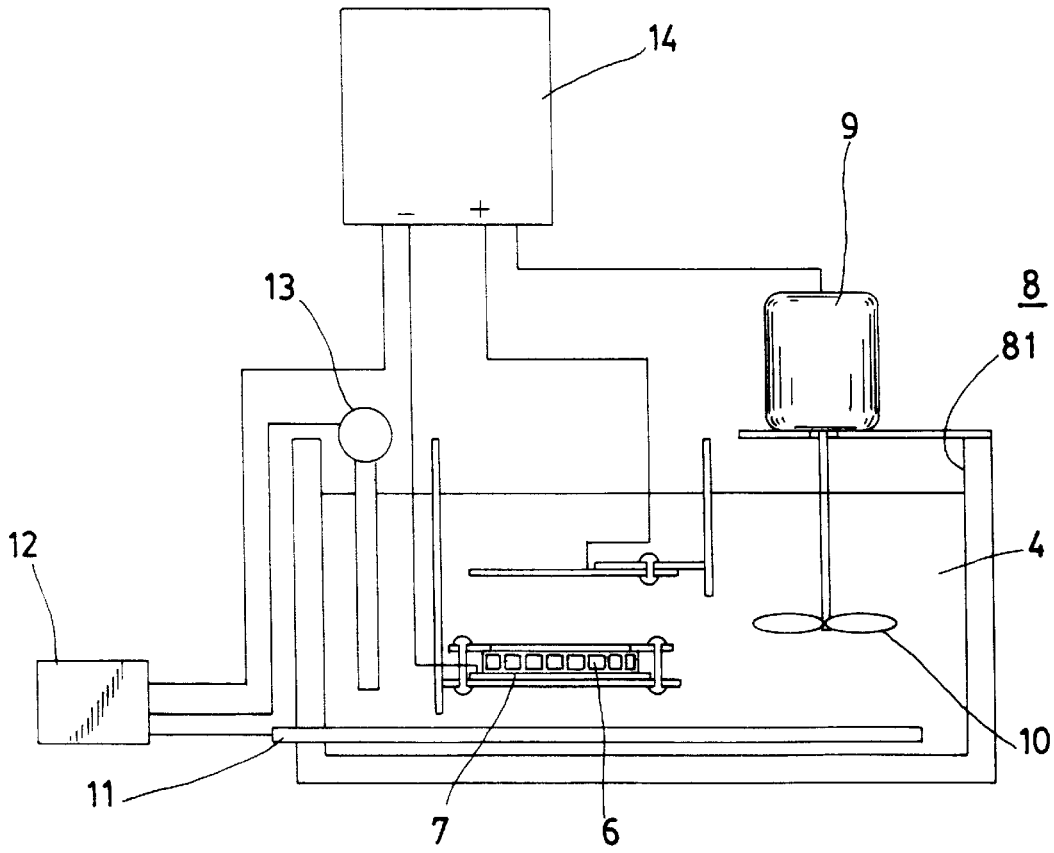
FIG. 2 shows an electroforming systematic equipment of the present invention.

The microfabrication process of the present invention comprises the steps of:

1. Preparing an Electrolyte Solution:

As shown in FIG. 2, an electrolyte solution 4 is prepared to be filled in an electroforming system 8. The electroforming system 8 is adapted for conducting electroforming process which will be described in detail hereinafter.

Figure 1:
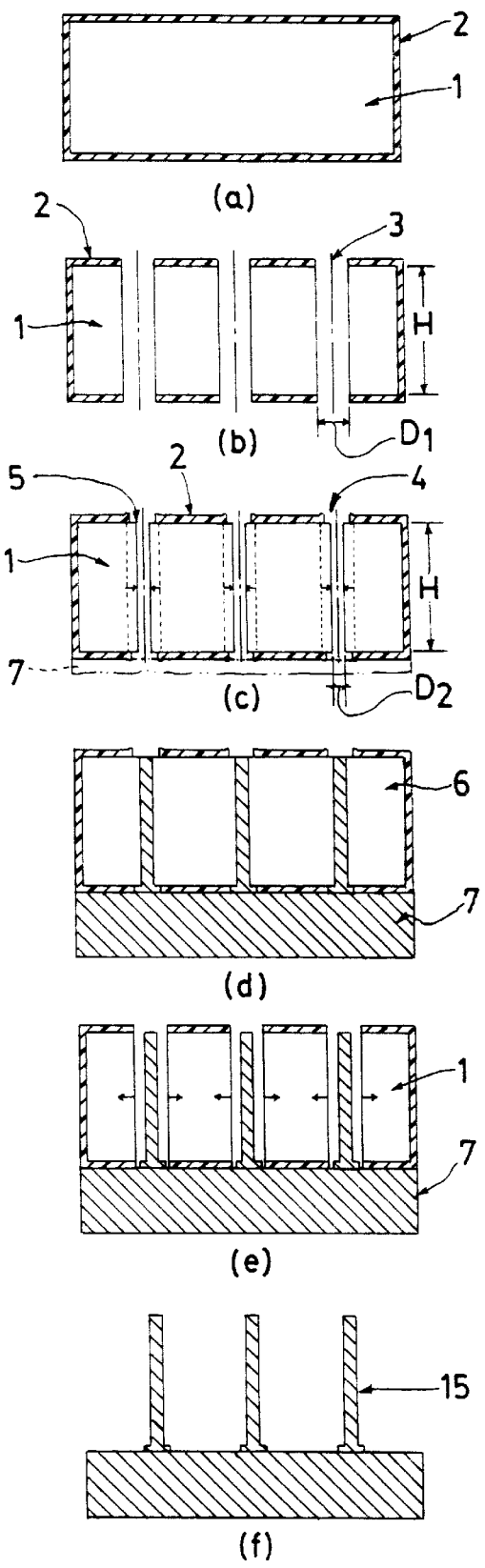
FIG. 1 shows the major process steps in accordance with the present invention.

2. Forming a Masking Film on a Polymer Substrate:

Referring now to FIG. 1, a polymer substrate 1 capable of massively absorbing the electrolyte solution containing large aqueous solution is chosen for surface treatment including flattening, polishing and cleaning on the outer surface of the substrate. A thin protective masking film 2 is then circumferentially formed on or disposed around the substrate 1 as shown in FIG. 1*a*. Several methods for forming the film 2 on the substrate 1 may be applied including coating by a coating machine, or deposition by vapor deposition such as PVD or CVD, or by electroless plating. The substrate may be selected from hydrophilic polyurethane, hydrophilic acrylic resin, and other suitable polymers. The masking film 2 should be electrically insulative.

The masking film 2 should preclude penetration or mass transfer of an electrolyte into an interior in the substrate 1. The film may also not be debonded or dissolved by the electrolyte solution during the subsequent mass transport saturation or electroforming steps.

The substrate 1 as selected should be massively swelled by a mass transport of the electrolyte solvent into the interior of the substrate without being damaged by the electrolyte.

Other film forming methods, such as sputtering, plasma spray, spin coating, etc., may be used in this invention.

Figure 3:
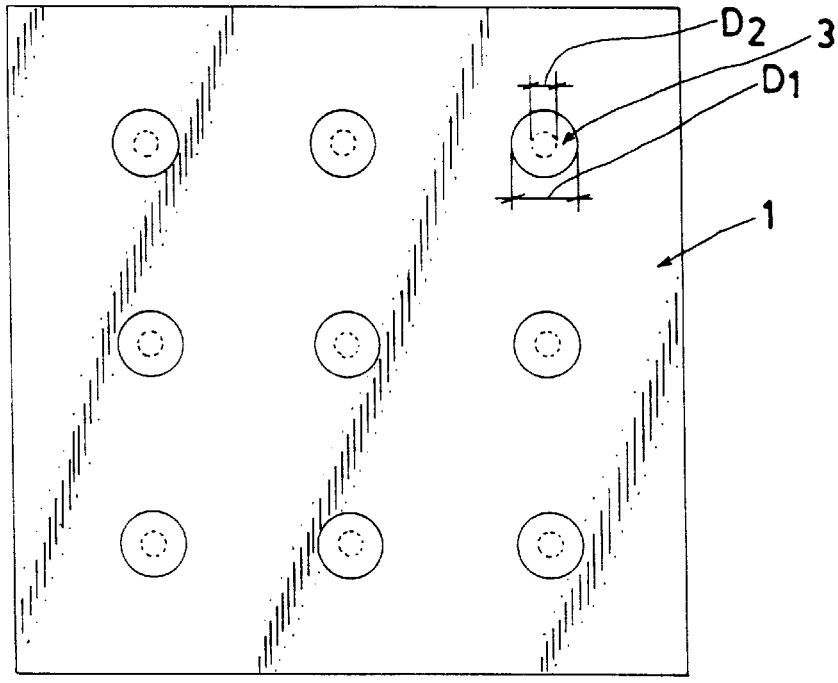
FIG. 3 is a top view of the substrate micromachined in accordance with the present invention.

3. Micromachining the Substrate for Forming Deep-cavity Pattern of the Microstructure:

By using micromachining tools or methods for forming deep cavities or gaps 3 of the pattern in the substrate 1 as shown in FIG. 1*b* for forming a primary width or diameter D1 (also shown in FIG. 3) in each deep cavity 3. The pattern thus obtained should have the desired optimum dimension, shape precision and minimum roughness of the side wall.

The micromachining methods include: poly-crystal diamond (PCD) machining, laser-beam machining (LBM), electron-beam machining (EBM), etc.

4. Shrinking the Width or Diameter of Each Deep Cavity of the Pattern by Swelling the Substrate:

The micromachined substrate is closely joined on a cathode nickel plate 7 and dipped in the electrolyte solution 4 filled in the electroforming system 8 (Shown in FIG. 2) to diffuse the electrolyte solvent into the interior of the polymer substrate 1 by mass transport of the electrolyte solvent for swelling the polymer (FIGS. 1*c*, 1*d*). The swelling 5 of the polymer within each deep cavity 3 of the pattern will shrink the width or diameter of the cavity, thereby minimizing the width or diameter of each cavity 3 from D1 to D2 (FIG. 1).

Figure 4:
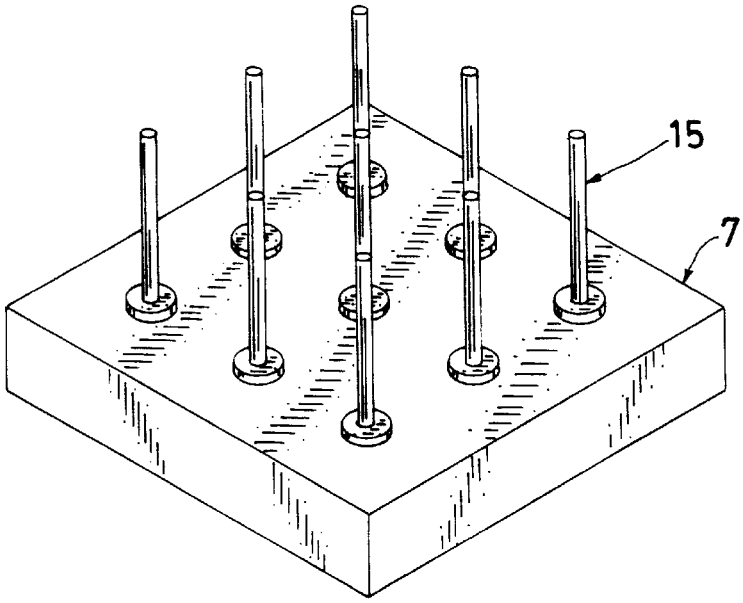
FIG. 4 is a perspective view of the microstructure product of the present invention.

For instance, if the depth of the cavity 3, which in turn will become the height of the product 15 as shown in FIG. 1*f* and FIG. 4, is defined as H, the first width (or diameter) of each cavity 3 after micromachining as D1, and the second width (or diameter) of each cavity 3 after shrinking (or swelling of the polymer) as D2, the following formulas will be obtained:

$$R1=H/D1,$$

wherein the R1 is the aspect ratio of micromachining without shrinking;

$$R2=H/D2,$$

wherein the R2 is the aspect ratio after shrinking.

Since D2 is smaller than D1, R2 will be greater than R1, thereby increasing the aspect ratio in accordance with the present invention.

Accordingly, if the first width (D1) of a cavity is micromachined by PCD method to be 300 microns with a height (H) of 9.9 mm, an aspect ratio (R1) of 33 will be obtained; and after being treated by the present invention, the second width (D2) after shrinking has become 75 microns with the same height (H), and the aspect ratio (R2) will then be:33×300/75=132, thereby greatly increasing the aspect ratio and enhancing the miniaturization to be beneficial for microfabrication.

The swelling of the polymer for shrinking the cavities (cavity size) of the pattern is caused by the mass transport of the molecules of a bad solvent of the electrolyte 4 into the free volume of the polymer interior of the substrate 1 to increase the distance between the molecular chains so as to form swelling 5 of the polymer.

Such a mass transport phenomena may occur due to Fickian diffusion, Case II diffusion or anomalous diffusion. The shrinking of the cavity dimension is a function of the variables including mass transport temperature and the saturated absorption capacity or rate of the electrolyte solvent as absorbed by the polymer.

Upon a saturation of the mass transport of the electrolyte solvent into the polymer, the swelling 5 of the polymer will reach a fixed dimension, thereby shrinking the cavity 3 at a fixed size which can be predetermined.

The polymer as used in this invention should allow the mass transport of the electrolyte solvent into the interior of the polymer to perform massive swelling of the polymer without being damaged during the swelling.

The electrolyte solution as used for swelling the polymer is the same electrolyte as used in the subsequent electroforming step in this invention. Those areas of the substrate covered with the masking film 2 will not be attacked by the electrolyte due to mass transfer of the electrolyte.

5. Electroforming:

The swelled substrate 6 having the cavities 3 filled with the electrolyte 4 therein is now subjected to electroforming process in the electroforming system.

The electroforming system (equipment) 8 as shown in FIG. 2 includes: a bath 81 filled therein with the electrolyte solution 4, a power supply 14 having an anode and a cathode electrically connected to the nickel plate 7 which has been already joined with the swelled substrate 6, a stirrer 10 secured to a DC motor 9 with variable rotation speed for homogeneously agitating the electrolyte solution 4 in the bath 81, a heating coil 11 formed in the bath for heating the electrolyte solution to a proper temperature which is kept constant by a temperature controller 12 and a sensor 13.

The power supply 14 provides the suitable current and voltage for conducting the electroforming process for electrodeposition of the metal in each cavity 3 in the swelled substrate 6 until filling the cavities in the swelled substrate 6 to the predetermined height or depth H. Then, the power supply 14 is disconnected.

The metals or alloys which may be electrodeposited in the electroforming step include: nickel, copper, gold, nickel-cobalt alloy, nickel-iron alloy, etc.

6. Desorption and Demolding:

The electroforming product from the foregoing step is then conducted with desorption of the electrolyte from the polymer for recovering (or retracting) the polymer to its original pattern for an easy separation of the electroformed microstructure from the polymer. The polymer 1 is then separated from the electroforming microstructure 15 as shown in FIG. 1*e* due to the desorption of the electrolyte which can be effected by heating or by diffusion.

The microstructure product 15 is then demolded and separated from the substrate 1 as shown in FIGS. 1*f* and 4.

The polymer 1 as swelled and finally recovered during the process steps will not be dissolved or decomposed into the electrolyte solution in accordance with the present invention.

The present invention may be further described in detail with reference to the following example.

EXAMPLE

A substrate plate of hydrophilic polyurethane (PU) with thickness of 2 cm is selected for surface treatment by flattening and polishing. A water insoluble graphite ink or persimmon oil is applied to coat all the parallelepiped outer surfaces of the substrate. $CO_2$ laser with wave length of 193 nm is used to drill a plurality of hole (e.g. 100×100) in the substrate. Each hole "do" has an inside diameter of about 400 microns.

An electrolyte solution is prepared to contain the following ingredients: nickel ammonium sulfate 16 l, boric acid 0.8 l, nickel chloride 0.4 l, and brightening agent 0.4 l, which are thoroughly dissolved at 35° C. Deionized water is added to adjust its specific gravity to be 40, and the pH value is measured and adjusted to be 4. If it is too acidic, a nickel carbonate is added until reaching pH 4.0.

The substrate is then joined on a nickel-plate cathode and dipped in the electrolyte solution for mass transport of the electrolyte solvent into the polymer at 40° C. Upon saturation of the mass transport in the PU polymer, the polymer is swelled to shrink the hole inside diameter "d" to be 100 microns. So, the size reduction rate is obtained as: $d_0-d/d_0\times 100\%=400-100/400\times 100\%=75\%$ The swelled substrate is then conducted for electroforming at 40° C. for 54 hours with power supply of 2.0V and 2.0A.

The electroforming product is then placed in an air oven at 100° C. for desorption and demolding of the three-dimensional microstructure product 15 as illustrated in FIG. 4 having an aspect ratio of 100, with simplified process steps and decreased production cost.

The shapes of the microstructures are not limited in the present invention. Each microstructure may also be formed with a hole or plural holes formed in the microstructure.

In accordance with the present invention, a microstructure of high aspect ratio larger than 100 can be made. The process steps are simplified and the production cost is decreased, thereby improving the drawbacks of time-consuming and low production efficiency as found in a conventional microfabrication process.

Several essential "key-point" steps are advantageous for the present invention, such as, the swelling of the polymer just before the electroforming step minimizing the cavities in the polymer for greatly increasing the aspect ratio; and the desorption of the electrolyte from the polymer easily separating the electroformed microstructure from the polymer with the desoption simply effected by heating, thereby eliminating those complex etching steps as found in the conventional process steps and thereby enhancing environmental protection by solving the pollution problems caused by the etching solvents. The swelling of the polymer and the recovery (shrinkage) of the polymer seems to be a "reversible reaction", but helpful for the increase of aspect ratio and beneficial for the demolding of the microstructure product, thereby resulting in improvement of the present invention over the conventional arts.

Meanwhile, the microstructure as produced in the present invention may be copied to form a mold cavity in a mold for mass production of molding products such as through injection molding, or other molding or manufacturing processes.

The present invention may be modified without departing from the spirit and scope of this invention.

What is claimed is:

1. A microfabrication process comprising the steps of:

a. preparing an electrolyte solution to be filled in an electroforming system;

b. selecting a polymer substrate capable of absorbing a solvent of the electrolyte solution to be swelled by the solvent, and treating an outer surface of the polymer substrate for flattening, polishing and cleaning the outer surface, and forming an electrically insulative masking film on the outer surface of the polymer substrate;

c. micromachining the polymer substrate for forming a three-dimensional microstructure pattern with a plurality of deep cavities in said polymer substrate, each said deep cavity defining a depth, which in turn is a height (H) of a microstructure;

d. joining said polymer substrate closely on a cathode plate for said electroforming system and dipping the polymer substrate in said electrolyte solution filled in said electroforming system to allow mass transport of said solvent of the electrolyte solution into said polymer substrate for swelling the polymer substrate until being saturated by the solvent, and for shrinking an original diameter or width of each of said deep cavities in said substrate to be a minimized diameter or width (D2) of each said deep cavity;

e. electroforming for filling metal or alloy in the cavities in the polymer substrate in said electroforming system having said cathode plate and an anode electrically connected in said electroforming system; and f. description of electrolyte solvent from the polymer substrate to shrink the polymer substrate to be separated from a microstructure as electroformed in each said cavity of said polymer substrate, and demolding the microstructure for obtaining an electroforming microstructure having an aspect ratio (H/D2) which is increased because the minimized diameter or width (D2) of each said cavity is smaller than the original diameter or width (D1) of said cavity.

2. A microfabrication process according to claim 1, wherein said polymer substrate is a hydrophilic polymer.

3. A microfabrication process according to claim 2, wherein said polymer includes: hydrophilic polyurethane, and hydrophilic acrylic resin.

4. A microfabrication process according to claim 1, wherein said electroforming includes electrodeposition of metal or alloy selected from the group consisting of: nickel, copper, gold, nickel-cobalt, and nickel-iron.

* * * * *